United States Patent [19]

Weiss et al.

[11] 4,040,782

[45] Aug. 9, 1977

[54] NOISE REDUCTION INSERT FOR APPARATUS TO PREVENT MELTED YARN STOPPED IN A HIGH TEMPERATURE YARN TEXTURING JET

[75] Inventors: William Robert Weiss, Walnut Creek, Calif.; Anthony Michael Saich; James Judson Cooksey, both of Colonial Heights, Va.

[73] Assignee: Allied Chemical Corporation, Morris Township, N.J.

[21] Appl. No.: 631,810

[22] Filed: Nov. 14, 1975

[51] Int. Cl.[2] ..... D02G 1/16

[52] U.S. Cl. ..... 28/271; 55/276; 181/56; 239/590.3

[58] Field of Search ..... 28/1.4, 72.12, 271; 239/590.3, 558, 265.13; 302/25, 63; 181/33 R, 35 R, 56; 55/276

[56] References Cited

U.S. PATENT DOCUMENTS

| | | | |
|---|---|---|---|
| 3,009,529 | 11/1961 | Brown | 239/590.3 X |
| 3,537,543 | 11/1970 | Gibel | 181/56 |
| 3,842,468 | 10/1974 | Harrison | 28/1.4 |
| 3,898,063 | 8/1975 | Gazan | 55/276 |

*Primary Examiner*—Louis K. Rimrodt
*Attorney, Agent, or Firm*—Richard A. Anderson

[57] ABSTRACT

An insert is disclosed to reduce noise for apparatus to prevent melted yarn stopped in high temperature yarn texturing jet. The insert is a cylinder at the outlet of the orifice emitting a cooling, diluting and diverting fluid, such as air, to prevent yarn when stopped in the steam texturing jet from being melted. The insert comprises a cylinder having a series from about 5 to 10 cylindrical openings evenly distributed across the orifice and with axes parallel to the orifice axis. The cylindrical openings preferably have a length to diameter ratio of from about 5 to about 10.

2 Claims, 3 Drawing Figures

NOISE REDUCTION INSERT FOR APPARATUS TO PREVENT MELTED YARN STOPPED IN A HIGH TEMPERATURE YARN TEXTURING JET

BACKGROUND OF THE INVENTION

This invention relates to apparatus to prevent melted yarn when stopped in a high temperature yarn texturing jet such as the one shown in U.S. Pat. No. 3,409,956, to Longbottom et al., hereby incorporated by reference. More particularly, this invention relates to an insert to reduce the noise when the apparatus disclosed in U.S. Pat. No. 3,842,468 to Harrison, hereby incorporated by reference, is operational. This prior art apparatus functioned properly to prevent melted yarn when the yarn was stopped in the high temperature yarn texturing jet. However, when operating the prior art apparatus caused objectionable noise, i.e., decible readings above that allowable for operation in a plant without ear protection.

SUMMARY OF THE INVENTION

This invention consists of an insert to the device attached to the high temperature yarn texturing jet such as the one disclosed in the above-mentioned Harrison and Longbottom patents. The insert of the invention has reduced the noise level of prior art apparatus for preventing melted yarn in high temperature yarn texturing jet from above 90 decibels to about 87 decibels. Other measures were used to lower the level to below 85 decibels so that ear protection is not necessary due to operation of this device.

The prior art apparatus to prevent melted yarn when stopped in a high temperature yarn texturing jet device, having a high temperature fluid flowing across the yarn entry, comprised a sensor to detect yarn stoppage which actuated a valve in a high pressure fluid conduit communicating with an orifice drilled opposite the yarn entry in the high temperature yarn texturing jet device, so that on actuation of the valve by the sensor a blast of high pressure fluid diverts and dilutes any undiverted high temperature fluid flowing across the yarn entry in the texturing device through the yarn entry. The improvement comprises a noise reduction insert at the orifice. The insert comprises a cylinder having a series of from about 5 to 10 cylindrical openings evenly distributed across the orifice and with axes parallel to the orifice axis. Preferably, the cylindrical openings have a length to diameter ratio of from about 5 to about 10. Particularly preferable is a length to diameter ratio of about 6.25. Preferably the insert has seven cylindrical openings and a tapered inlet adjacent the inlet of the cylindrical openings.

DESCRIPTION OF THE PREFERRED EMBODIMENT

Figure 1:
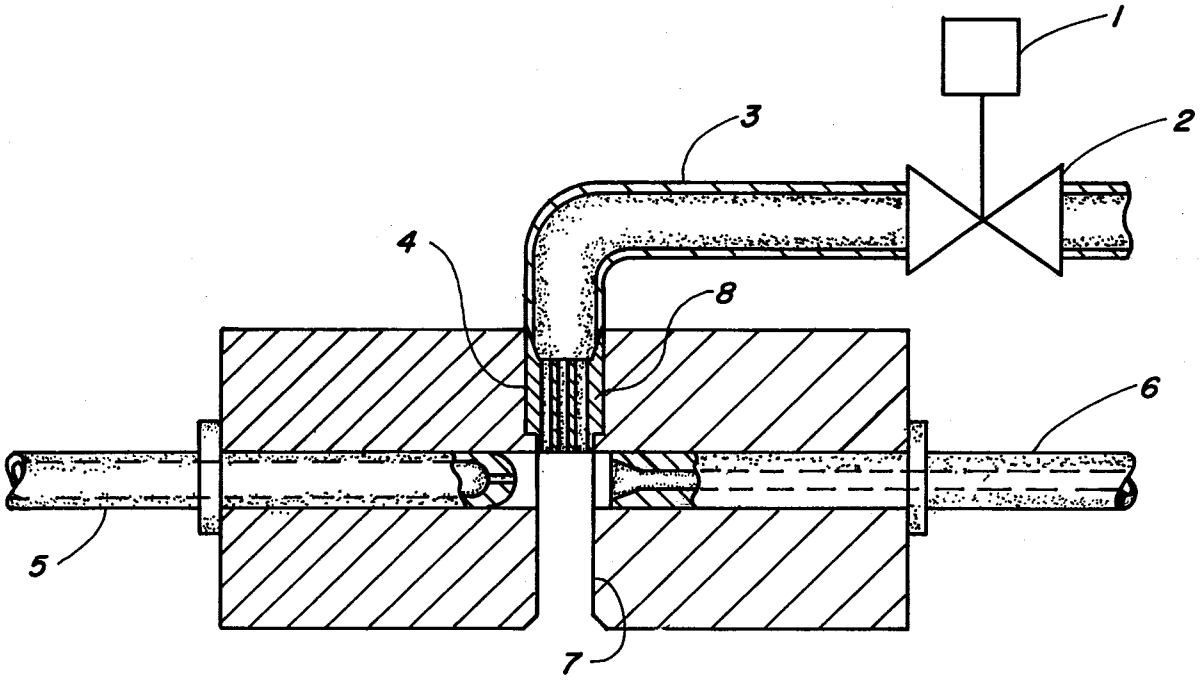
FIG. 1 shows the apparatus to prevent melted yarn when stopped in a high temperature yarn texturing jet of the prior art with the insert of this invention in place.

FIG. 1 shows the apparatus of the prior art invention with the insert 8 of this invention in place at orifice 4. The sensor 1, such as a feeler arm, described in U.S. Pat. No. 3,438,188 to Boggs, hereby incorporated by reference, senses when the yarn is stopped and actuates a valve 2 in high pressure fluid conduit 3 thereby providing a blast of high pressure fluid, such as air, to orifice 4 to divert and dilute any high temperature fluid, such as steam, flowing from steam entry tube 5 across yarn slot 7 out through yarn entry slot 7 as a steam and air mixture rather than downstream into energy tube 6. Thus any yarn stopped in energy tube 6 or other elements downstream from yarn slot 7 will no longer be heated so that the yarn can cool rather than melt after it stops. The insert 8 of this invention changes the noise frequency spectrum of the high pressure fluid emitting from orifice 4 by breaking it into smaller jets. Thus, the noise is modified by causing the frequency of peak sound vibrations to be shifted above the human hearing range and therefore predominantly above the range which would cause damage to the human ear.

Figure 3:
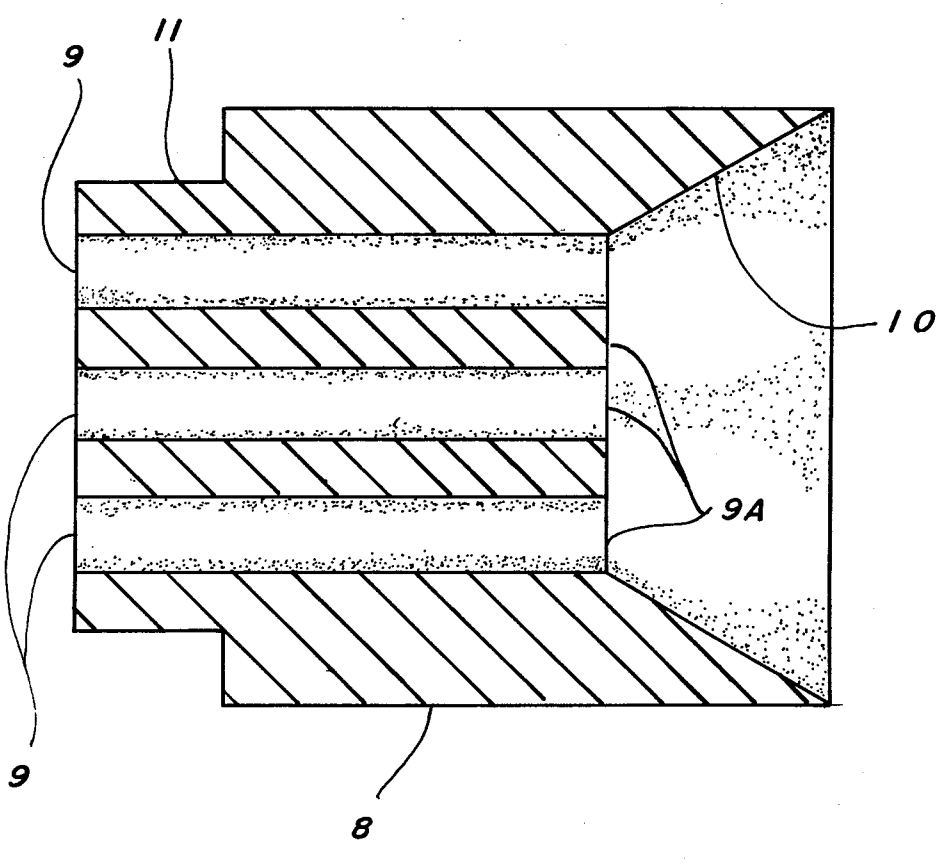
FIG. 3 shows a cross section of the insert of this invention across the insert as shown by arrows marked 3 in FIG. 2.
Figure 2:
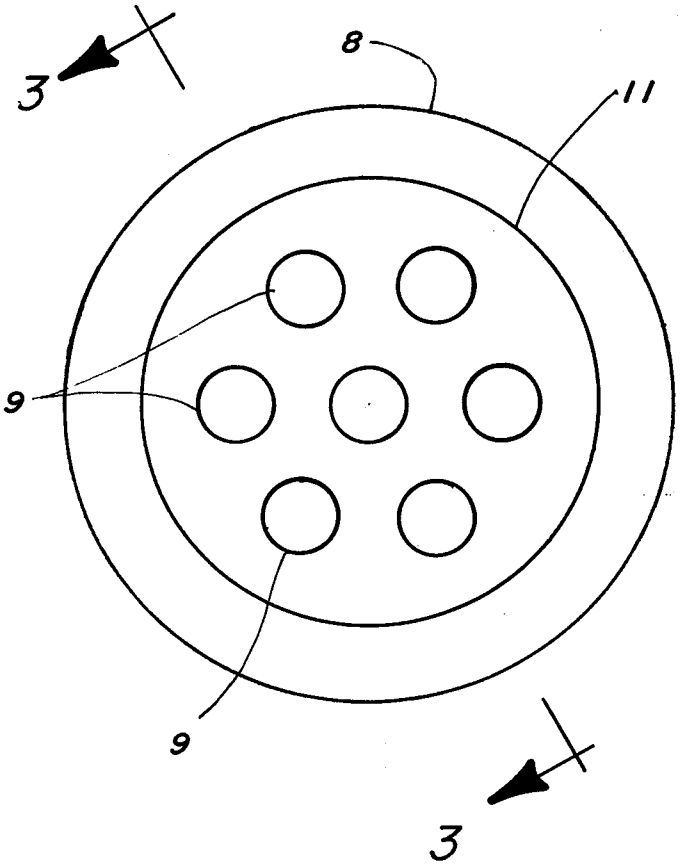
FIG. 2 is an end view of the insert of this invention.

FIG. 3 shows a cross section of insert 8 with cylindrical openings 9 and tapered inlet 10. Note that tapered inlet 10 is adjacent the inlet openings 9A to cylindrical openings 9. Insert 8 has a smaller outside diameter at 11 so that the insert 8 may be fastened within orifice 4. FIG. 2 is a cross section across FIG. 3 as shown by the arrows marked A in FIG. 3.

FIG. 2 is an end view of insert 8 showing a preferred embodiment with seven cylindrical openings 9.

We claim:

1. In an apparatus to prevent melted yarn when stopped in a high temperature yarn texturing jet device, having a high temperature fluid flowing across a yarn entry, comprising a sensor to detect yarn stoppage which actuates a valve in a high pressure conduit communicating with an orifice opposite said yarn entry in said high temperature texturing jet device so that upon actuation of said valve by said sensor, a blast of high pressure fluid diverts and dilutes any undiverted said high temperature fluid flowing across said yarn entry in said texturing jet device out of said texturing jet device through said yarn entry, the improvement comprising a noise reduction insert at said orifice, said insert comprising a cylinder having a series of from about 5 to 10 cylindrical openings evenly distributed across said orifice and with axes parallel to said orifice axis; said cylindrical openings having a length to diameter ratio of from about 5 to 10, and said insert having a tapered inlet adjacent the inlet of said cylindrical openings.

2. The insert of claim 1 wherein said length to diameter ratio is 6.25, and said insert has seven said cylindrical openings.

* * * * *